US006565077B2

(12) United States Patent
Kawada

(10) Patent No.: US 6,565,077 B2
(45) Date of Patent: May 20, 2003

(54) PAPER FEED APPARATUS

(75) Inventor: Shunichiro Kawada, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/905,940

(22) Filed: Jul. 17, 2001

(65) Prior Publication Data

US 2002/0011704 A1 Jan. 31, 2002

(30) Foreign Application Priority Data

Jul. 26, 2000 (JP) ..... 2000-225412

(51) Int. Cl.[7] ..... B65H 5/00

(52) U.S. Cl. ..... 271/10.03; 271/10.11; 271/117

(58) Field of Search ..... 271/10.09, 10.11, 271/117, 264, 10.03, 10.01

(56) References Cited

U.S. PATENT DOCUMENTS 5,927,703 A * 7/1999 Endo ..... 271/10.11

6,234,470 B1 * 5/2001 Okitsu et al. ..... 271/10.11

* cited by examiner

*Primary Examiner*—John M. Jillions
(74) *Attorney, Agent, or Firm*—Gary M. Nath; Harold L. Novick; Marvin C. Berkowitz

(57) ABSTRACT

A paper feed apparatus comprises primary paper feed device 3 sequentially transferring only an uppermost print sheet P on a paper feed tray, and secondary paper feed device 4 guiding a tip end of the print sheet P transferred by the primary paper feed device 3 by a pair of guide members 12 and 13, introducing the print sheet P to a portion between a pair of secondary paper feed rollers 10 and transferring the print sheet P introduced to the portion between the pair of secondary paper feed rollers 10 to a transport downstream side according to rotation of the pair of secondary paper feed rollers 10. The paper feed apparatus is provided with a guide distance adjustment device 14 for making a distance between the pair of guide members 12 and 13 variable. The guide distance adjustment device 14 rotates eccentric cams 22 by rotation of an operation member 20. A position of the upper guide member 12 is vertically changed to follow up lower surface positions of the eccentric cams 22, thereby making the distance between the pair of guide members 12 and 13 variable.

3 Claims, 6 Drawing Sheets

PAPER FEED APPARATUS

BACKGROUND OF THE INVENTION

1. Field of the Invention

The present invention relates to a paper feed apparatus for sequentially transferring only an uppermost sheet out of sheets mounted on a paper feed tray in a stacked state at predetermined timing.

2. Description of the Related Art

There is proposed a paper feed apparatus of such a type as shown in FIG. 1. FIG. 1 is a schematic side elevational view of the proposed paper feed apparatus. A paper feed apparatus 100 includes a paper feed tray 102 for mounting many sheets 101 in a stacked state, primary paper feed device 103 for transferring only the uppermost sheet 101 on the paper feed tray 102, and secondary paper feed device 106 for transferring the sheet 101 transferred by the primary paper feed device 103 to a portion between a printing drum 104 and a press roller 105 at predetermined timing.

The primary paper feed device 103 includes a scraper roller 107 press-contacted with the uppermost sheet 101 on the paper feed tray 102, a stripper plate 108 arranged in the vicinity of the downstream side of the scraper roller 107, and a pickup roller 109 substantially press-contacted with the stripper plate 108. The scraper roller 107 and the pickup roller 109 are driven to rotate in the same direction by primary driving device (not shown). The secondary paper feed device 106 includes a pair of secondary paper feed rollers 110 arranged downstream of the primary paper feed device 103 in a sheet transfer direction, and a pair of guide members 112 and 113 providing a transfer path 111 between the members 112 and 113 in the vicinity of the paired secondary paper feed rollers 110. The paired secondary paper feed rollers 110 are driven to rotate by secondary driving device (not shown). The upper guide member 112 guides only the neighborhood of the secondary paper feed roller 110 and the upstream side of the upper guide member 112 in the sheet transfer direction is formed as an inclined section 112*a* directed upward.

With the above-described constitution, when the scraper roller 107 and the pickup roller 109 are rotated, the uppermost sheet 101 on the paper feed tray 102 is applied with a transfer force and thereby transferred, whereby a sheet 101 under the uppermost sheet 101 is also transferred by frictional resistance between the sheet 101 and the uppermost sheet 101. If the sheet 101 is transferred to a position at which the tip end of the sheet 101 enters between the stripper plate 108 and the pickup roller 109, a plurality of sheets 101 are dealt with the stripper plate 108 and the transfer of sheets 101 other than the uppermost sheet 101 is stopped at the stripper plate 108. At the same time, only the uppermost sheet 101 is transferred to a downstream side. When the sheet 101 thus transferred is guided by the guide member 113 and transferred to a position near the paired secondary paper feed rollers 110, the sheet 101 enters the transfer path 111 between the paired guide members 112 and 113. If the sheet 101 passes this transfer path 111, the tip end of the sheet 101 is introduced to the portion between the paired secondary paper feed rollers 110 and, as shown in FIG. 2, the transfer of the sheet 101 is stopped in a state in which the tip end side of the sheet 101 is slightly bent. Next, the paired secondary paper feed rollers 110 are rotated synchronously with the rotation of the printing drum 104. If the paired secondary paper feed rollers 110 are rotated, the sheet 101 which has been transferred to the portion between the paired secondary paper rollers 110 is applied with a transfer force and thereby transferred to the portion between the printing drum 104 and the press roller 105 at predetermined timing. The sheet 101 is transferred to the portion between the printing drum 104 and the press roller 105 while being press-contacted with the portion and printing is conducted to the sheet 101 in this press-contact transfer course.

Meanwhile, the paired guide members 112 and 113 introducing the tip end of the sheet 101 transferred by the primary paper feed device 103 to the portion between the paired secondary paper feed rollers 110 are set to have a constant distance h therebetween in the proposed paper feed apparatus.

However, if the distance h between the paired guide members 112 and 113 is set to be wide enough to allow a thick sheet to pass through the transfer path with a margin left, correction of sheet corrugation cannot be expected to be exerted to a thin sheet, a sheet with less flexibility or a largely corrugated sheet after being left for a while. As a result, the problem that the printed sheet 101 is wrinkled occurs. That is, as shown in FIG. 3, if the sheet 101 has a corrugated portion "a" and passes between the paired secondary paper feed rollers 110 without correcting this corrugated portion "a", then the corrugated portion "a" is crushed between the paired secondary paper feed rollers 110 and the sheet 101 has wrinkles "b" as shown in FIG. 4.

On the other hand, if the distance h between the paired guide members 112 and 113 is set to allow a thick sheet (including an envelope and the like) to pass between the paired guide members 112 and 113 narrowly, correction of sheet corrugation is expected to be exerted to a thin sheet, a sheet with less flexibility or a sheet corrugated after being left for a while. However, the problem that the thick sheet tends to clog occurs.

SUMMARY OF THE INVENTION

The present invention has been made to solve the above-described problems. It is, therefore, an object of the present invention to provide a paper feed apparatus which does not cause paper clogging when thick sheets are used and which does not generate wrinkles on sheets if thin sheets are used.

The first aspect of the invention provides a paper feed apparatus comprising: a paper feed tray for mounting a plurality of sheets in a stacked state; primary paper feed device for sequentially transferring only the uppermost sheet out of the sheets on the paper feed tray; a pair of secondary paper feed rollers arranged downstream of the primary paper feed device in a sheet transfer direction, and a pair of guide members providing a transfer path between the pair of guide members near the pair of secondary paper feed rollers; secondary paper feed device for introducing tip ends of the sheets transferred by the primary paper feed device by using the pair of guide members to a portion between the paired secondary paper feed rollers, and for transferring the sheets introduced to the portion between the pair of secondary paper feed rollers to a transport downstream side according to rotation of the pair of secondary paper feed rollers; and guide distance adjustment device for making a distance between the pair of guide members variable, wherein the guide distance adjustment device comprises an operation member operated by a user, and the guide distance adjustment device makes the distance between the pair of guide members variable by operating the operation member.

According to the first aspect of the invention, if the sheets are thick, the distance between a pair of guide members is set wide, thereby transferring the sheets to the transfer path between the paired guide members with a margin left. If the sheets are thin sheets, sheets with less flexibility or the like, the distance between the paired guide members is set narrow. By doing so, the sheets are subjected to correction of sheet corrugation at the time of passing through the transfer path between the paired guide members and then introduced to the portion between a pair of secondary paper feed rollers. Due to this, it is possible to prevent wrinkles derived from the pressurization of corrugated portions by the paired secondary paper feed rollers. Furthermore, a user can freely, arbitrarily change the distance between the paired guide members in light of the thickness of the sheets to be used or the like.

The second aspect of the invention provides a paper feed apparatus comprising: a paper feed tray for mounting a plurality of sheets in a stacked state; primary paper feed device for sequentially transferring only the uppermost sheet out of the sheets on the paper feed tray; a pair of secondary paper feed rollers arranged downstream of the primary paper feed device in a sheet transfer direction, and a pair of guide members providing a transfer path between the pair of guide members near the pair of secondary paper feed rollers; secondary paper feed device for introducing tip ends of the sheets transferred by the primary paper feed device by using the pair of guide members to a portion between the paired secondary paper feed rollers, and for transferring the sheets introduced to the portion between the pair of secondary paper feed rollers to a transport downstream side according to rotation of the pair of secondary paper feed rollers; and guide distance adjustment device for making a distance between the pair of guide members variable, wherein the guide distance adjustment device comprises a rotatably provided eccentric cam, and the guide distance adjustment device makes the distance between the pair of guide members variable according to a rotation position of the eccentric cam.

According to the second aspect of the invention, the distance between the paired guide members can be changed by eccentric cams either continuously or by stages.

The third aspect of the invention provides a paper feed apparatus according to the second aspect of the invention, wherein the primary paper feed device comprises a primary paper feed roller, the primary paper feed roller comprises a paper feed pressure variable operation member for changing paper feed pressure for pressing the sheets in the stacked state on the paper feed tray, and the primary paper feed roller drives the guide distance adjustment device in association with the paper feed pressure variable member, so that the distance between the pair of guide members is made variable.

According to the third aspect of the invention, if the sheets are thick, a paper feed pressure variable operation member is operated to set paper feed pressure high. If the sheets are thin, the paper feed pressure variable operation member is operated to set paper feed pressure low. By doing so, the distance between the paired guide members is made variable in association with this paper feed pressure variable operation member.

The fourth aspect of the invention provides a paper feed apparatus according to the second aspect of the invention, wherein the paper feed apparatus is constituted to detect a slide ratio of the sheets when transferring the sheets to the secondary paper feed device by the primary paper feed mans, to drive the guide distance adjustment device according to the detected slide ratio and to thereby make the distance between the pair of guide members variable.

According to the fourth aspect of the invention, if the sheets are thick, a high slide ratio is detected and if the sheets are thin, a low slide ratio is detected. The distance between the paired guide members is made variable in association with this slide ratio.

DETAILED DESCRIPTION OF THE PREFERRED EMBODIMENTS

Hereinafter, the embodiments of the present invention will be described with reference to the drawings.

1. First Embodiment

Figure 1:
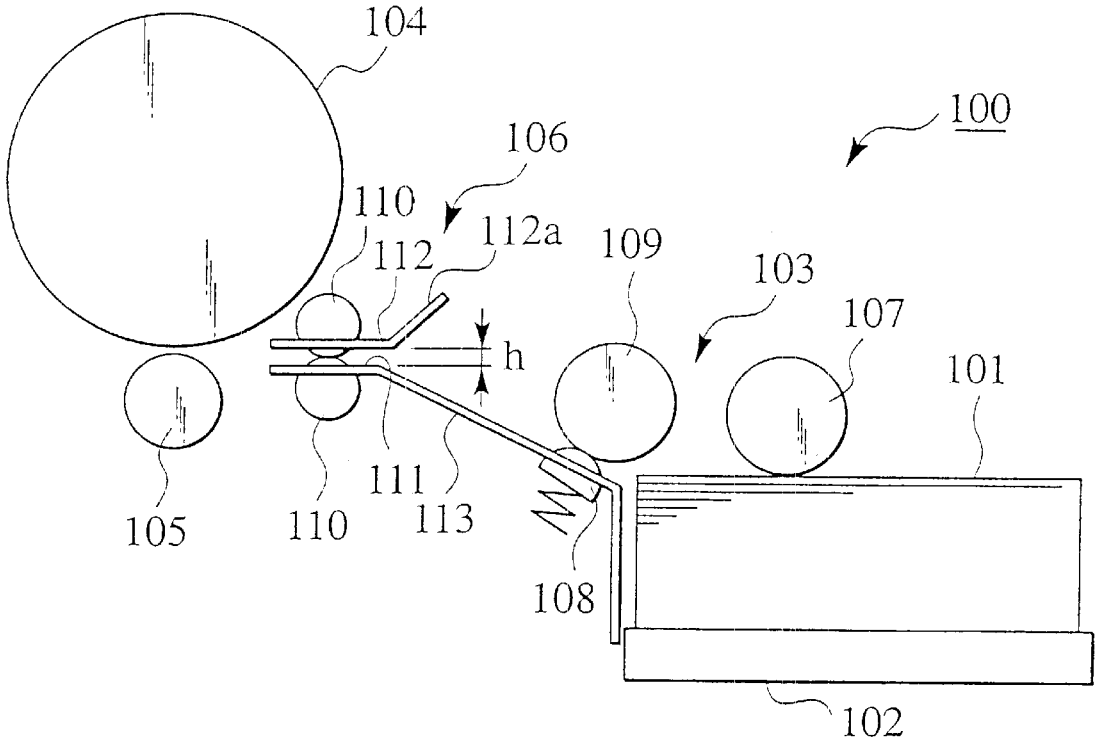
FIG.1 (Prior Art)
FIG. 1 is a schematic side elevational view of a proposed paper feed apparatus.
Figure 2:
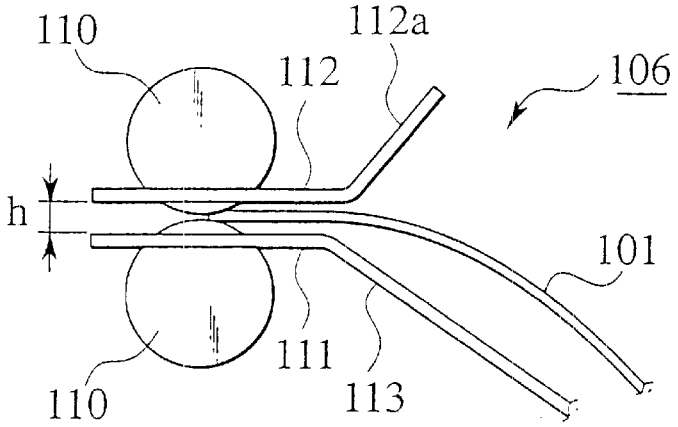
FIG.2 (Prior Art)
FIG. 2 is a side elevational view of the secondary paper feed device of the proposed paper feed apparatus.
Figure 3:
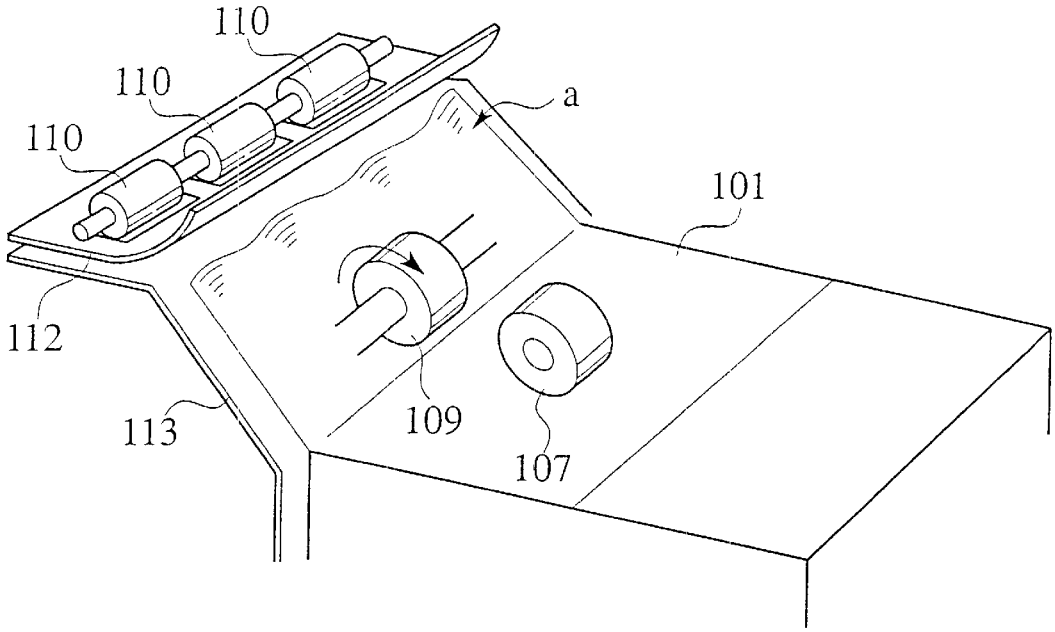
FIG.3 (Prior Art)
FIG. 3 is a perspective view of the proposed paper feed apparatus and showing a state before a print sheet having a corrugated portion passes secondary paper feed rollers.
Figure 4:
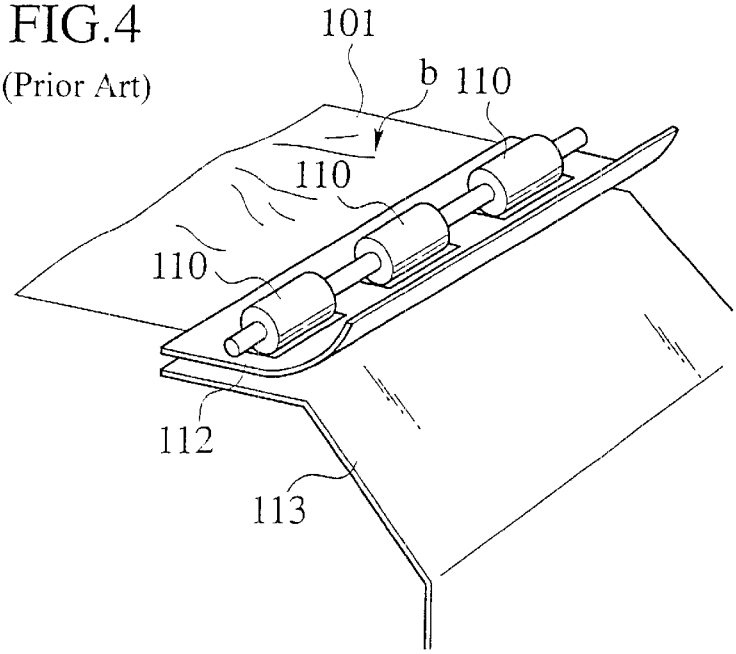
FIG.4 (Prior Art)
FIG. 4 is a perspective view of the proposed paper feed apparatus and showing a state in which the corrugated portion is crushed by the secondary paper feed rollers and the sheet is wrinkled.
Figure 5:
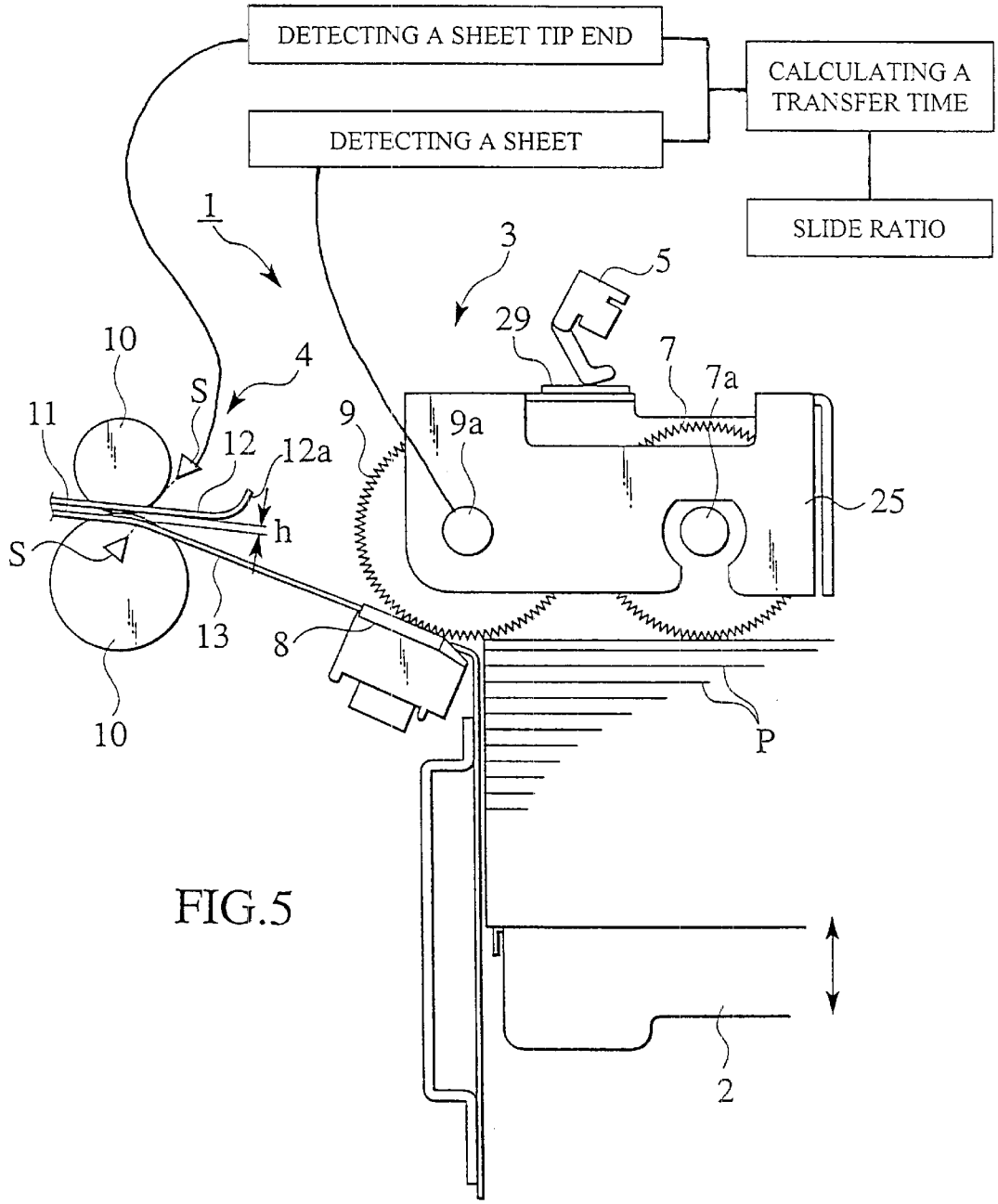
FIG. 5 is a schematic side elevational view of a paper feed apparatus according to the present invention.

As shown in FIG. 5, a paper feed apparatus 1 includes a paper feed tray 2 mounting many sheets or print sheets P in a stacked state, primary paper feed device 3 for transferring only the uppermost print sheet P on the paper feed tray 2, and secondary paper feed device 4 for transferring the print sheet P transferred by the primary paper feed device 3 to a portion between a printing drum (not shown) and a press roller (not shown) at predetermined timing.

The paper feed tray 2 is constituted by elevator ascending/descending device (not shown) so as to be vertically movable. The lower position and the upper position of the paper feed tray 2 are detected by a lower limit sensor (not shown) and an upper limit sensor 5, respectively. The lower position is a position for supplying the print sheets P or the like to the paper feed tray 2 or replacing the print sheets P or the like. The upper position is a position for transferring the print sheets P on the paper feed tray 2. The position of the uppermost stacked print sheet P is set by pressing the upper limit sensor 5 through a scraper roller 7 to be described later. If print sheets P are fed onto the paper feed tray 2, the position of the scraper roller 7 is lowered and the upper limit sensor 5 is turned off. Then, the paper feed tray 2 continues to rise until the upper limit sensor 5 is turned on, whereby the uppermost print sheet P is set at a position at which the uppermost print sheet P always presses the scraper roller 7.

The primary paper feed device 3 includes the scraper roller 7 for serving as a primary paper feed roller which is press-contacted with the uppermost print sheet P if the paper feed tray 2 is located at the upper position, a stripper plate 8 arranged in the vicinity of the downstream side of the scraper roller 7, and a pickup roller 9 substantially press-contacted with the stripper plate 8. The scraper roller 7 is press-contacted with the uppermost print sheet P on the paper feed tray 2. During the transfer of the print sheets P, paper feed pressure is generated by the press-contact between the scraper roller and the uppermost print sheet P. This paper feed pressure can be varied by paper feed pressure adjustment device 6 (see FIG. 7). The detailed constitution of the paper feed pressure adjustment device 6 will be described later.

The rotary shaft 7*a* of the scraper roller 7 and the rotary shaft 9*a* of the pickup roller 9 are rotatably supported by a roll support frame 25. The roll support frame 25 is supported by a paper feed apparatus main body so as to be rockable on a scraper roller 7 side. If the scraper roller 7 and the pickup roller 9 are not pressed by the print sheets P on the paper feed tray 2, the scraper roller 7 and the pickup roller 9 are slightly lowered. If pressed by the print sheets P on the paper feed tray 2, the scraper roller 7 and the pickup roller 9 are raised. The scraper roller 7 and the pickup roller 9 are driven to rotate in the same direction by primary driving device (not shown) in cooperation with each other. One-way clutches (not shown) are interposed between the scraper roller 7 and the rotary shaft 7*a* thereof and between the pickup roller 9 and the rotary shaft 9*a* thereof, respectively. In FIG. 5, the one-way clutches transmit the clockwise rotation of the shafts 7*a* and the clockwise rotation of the shaft 9*a* to the scraper roller 7 and the pickup roller 9, respectively, while not transmitting the opposite rotation thereof.

The secondary paper feed device 4 includes a pair of secondary paper feed rollers 10 arranged downstream of the primary paper feed device 3 in the sheet transfer direction, and a pair of guide device 12 and 13 providing a transfer path 11 therebetween in the vicinity of the paired secondary paper feed rollers 10. The paired secondary paper feed rollers 10 are driven to rotate by secondary driving device (not shown). The upper guide member 12 guides only the neighborhood of the secondary paper feed roller 10 and the upstream side of the upper guide member 12 in the sheet transfer direction is formed as an inclined section 12*a* directed upward. The lower guide member 13, which is arranged to extend from the paper feed tray 2 side to the position near the secondary paper feed roller 10, guides the transfer of the print sheets P. The distance h between the paired guide members 12 and 13 is made variable by guide distance adjustment device 14 to be described later. A sheet-in sensor S is provided while setting a position near the portion between the paired secondary paper feed rollers 10 as a detection position. If this sheet-in sensor S detects the tip end of the print sheet P, the driving of the primary paper feed driving device (not shown) is controlled to be stopped after the passage of a predetermined time.

Figure 6A:
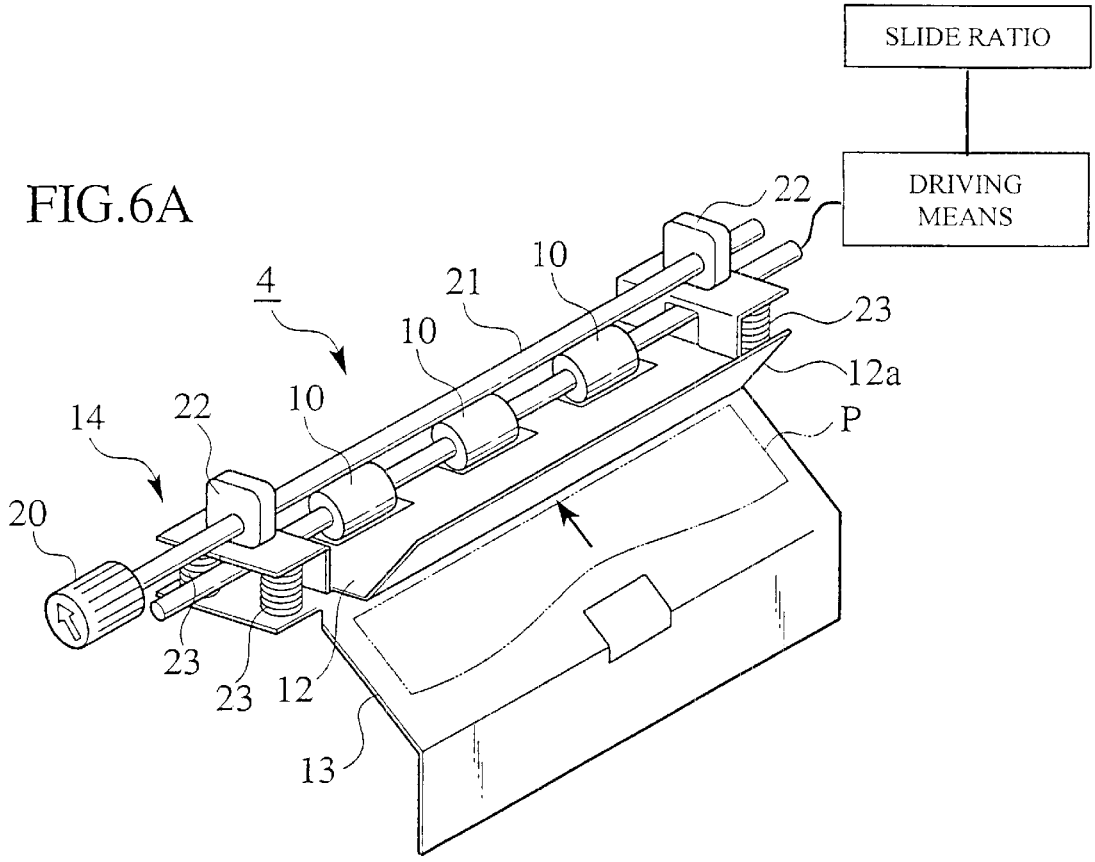
FIG. 6A is a perspective view of secondary paper feed device of the paper feed apparatus according to the present invention.
Figure 6B:
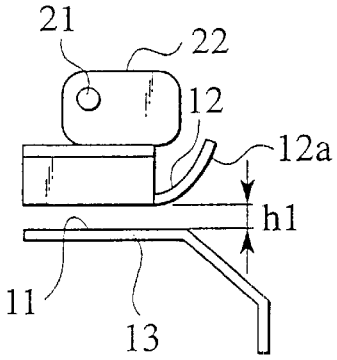
FIG. 6B is a side elevational view of the secondary paper feed device according to the present invention and showing that the distance between a pair of guide members is a small distance h1.
Figure 6C:
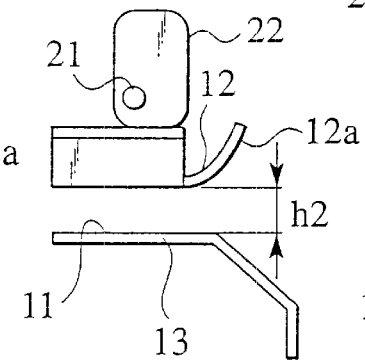
FIG. 6C is a side elevational view of the secondary paper feed device according to the present invention and showing that the distance between a pair of guide members is a normal distance h2.
Figure 6D:
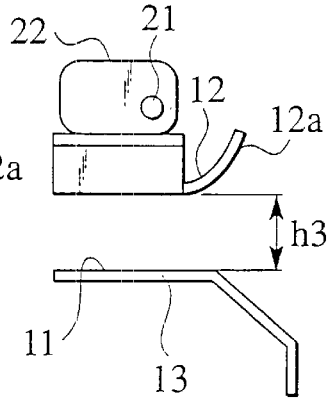
FIG. 6D is a side elevational view of the secondary paper feed device according to the present invention and showing that the distance between a pair of guide members is a large distance h3.

As shown in FIG. 6A, the guide distance adjustment device 14 includes an operation member 20 arranged at a position at which a user can carry out a rotation operation. A pair of right and left eccentric cams 22 are fixed to the support shaft 21 of the operation member 20. Each of the paired right and left eccentric cams 22 has a substantially rectangular parallelepiped shape and the distances from the center of the support shaft 21 to respective sides of a cross-section of the rectangular parallelepiped differ. The upper guide member 12 is arranged below the eccentric cams 22. The upper guide member 12 is supported to be vertically movable. Compressive spring 23 are provided on both right and left ends between the upper guide member 12 and the lower guide member 13, respectively. Spring forces of the compressive springs 23 urge the upper guide member 12 toward the eccentric cams 22 side. The upper guide member 12 moves vertically to follow up the surfaces of lower sides of the eccentric cams 22, whereby the distance h between the paired guide members 12 and 13 is variable to, for example, a small distance h1, an ordinary distance h2 or a large distance h3 as shown in FIGS. 6B to 6D.

The paper feed pressure adjustment device 6 includes a paper feed pressure variable operation member 26 (shown in FIG. 7) rotatably supported on the roller support frame 25 and operated by a user, and a paper feed pressure control arm 29 rock ably supported on the upper surface of the roll support frame 25 through a support pin 27 (shown in FIGS. 8A and 8B) and moved against the spring force of a spring 28 by the operation of the paper feed pressure variable operation member 26. By setting the upper surface of this paper feed pressure control arm 29 or the upper surface of the roll support frame 25 as the detection position of the upper sensor 5, the paper feed pressure becomes variable.

Figure 7:
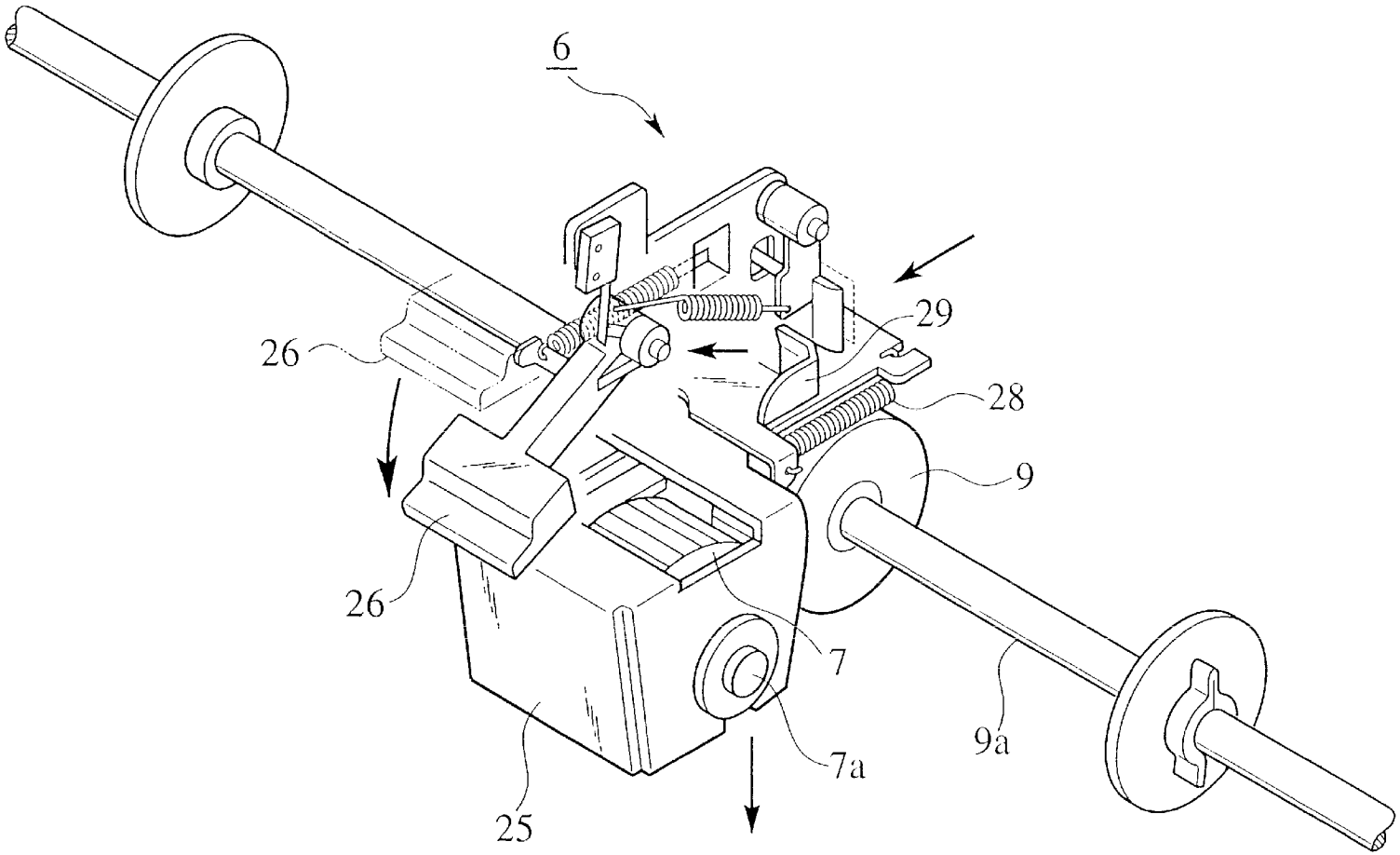
FIG. 7 is a perspective view of paper feed pressure adjustment device according to the present invention.
Figure 8A:
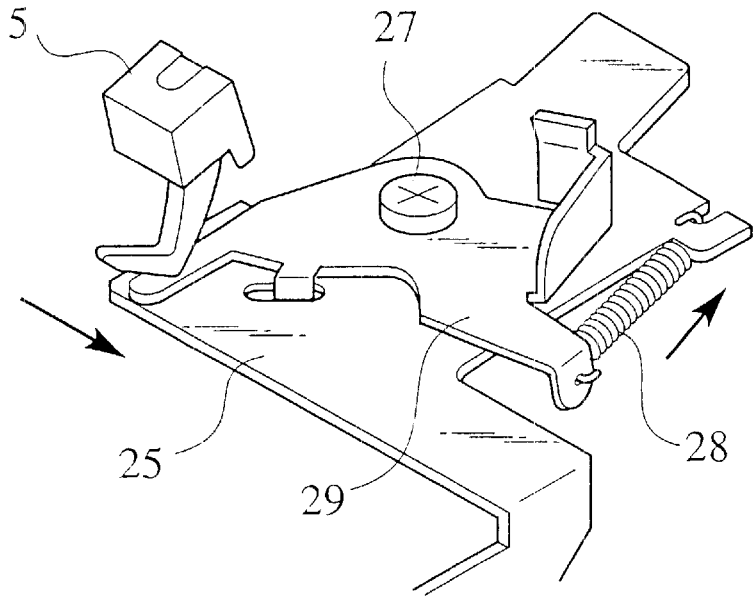
FIG. 8A is a perspective view of the paper feed pressure adjustment device according to the present invention and showing the arrangement of an upper limit sensor and a paper feed pressure control arm if the paper feed pressure is low (i.e., if an ordinary sheet is used)
Figure 8B:
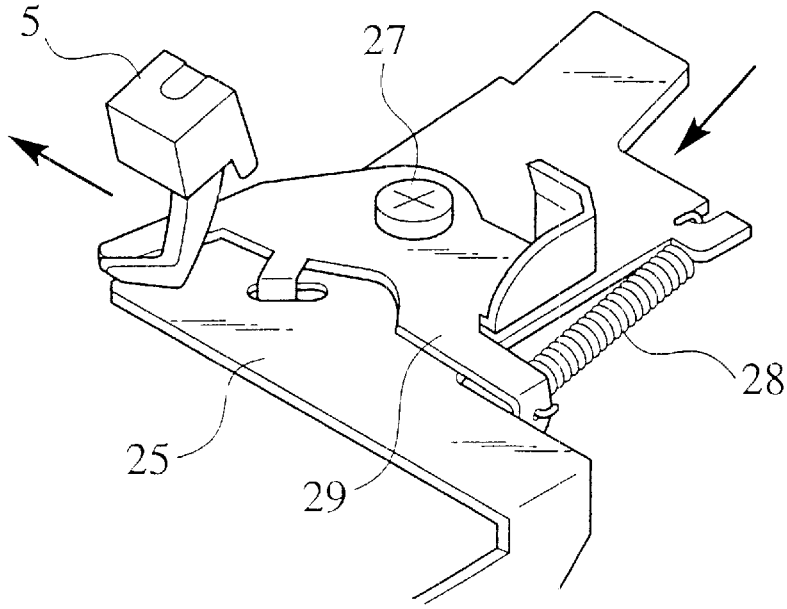
FIG. 8B is a perspective view of the paper feed pressure adjustment device according to the present invention and showing the arrangement of the upper limit sensor and the paper feed pressure control arm if the paper feed pressure is high (i.e., if a thick sheet is used).

As indicated by a two-dot chain line shown in FIG. 7, the upper position at which the paper feed pressure variable operation member 26 is located is a low paper feed pressure (that is, ordinary sheet) position. At this position, as indicated by solid lines shown in FIGS. 8A and 5, the upper sensor 5 is turned on while a force with which the sheets P press the scraper roller 7 is low and the upper limit sensor 5 uses the upper surface of the paper feed pressure control arm 29 as a detection position, thereby setting the paper feed pressure to be low. As indicated by a solid line shown in FIG. 7, the lower position at which the paper feed pressure variable operation member 26 is located is a high paper feed pressure (that is, thick sheet) position. At this position, as shown in FIG. 8B, the upper limit sensor 5 is turned on after the force with which the sheets P press the scraper roller 7 intensifies so that the upper limit sensor 5 uses the upper surface of the roll support frame 25 as a detection position, thereby setting the paper feed pressure to be high.

With the above-described constitution, when the scraper roller 7 and the pickup roller 9 are rotated, the uppermost print sheet P on the paper feed tray 2 is applied with a transfer force and thereby transferred. A print sheet P or the like under the uppermost print sheet P is also transferred by frictional resistance between the print sheet P and the uppermost print sheet P. If the print sheets P are transferred to a position at which the tip ends of the print sheets P enter the portion between the stripper plate 8 and the pickup roller 9, a plurality of print sheets P are dealt with the stripper plate 8. Then, while the transfer of the print sheets P other than the uppermost print sheet P is stopped, only the uppermost print sheet P is transferred to the downstream. The print sheet P thus transferred is guided by the lower guide member 13. If the print sheet P is transferred near the paired secondary paper feed rollers 10, the print sheet P enters the transfer path 11 between the paired guide members 12 and 13. If the paper sheet P passes this transfer path 11, the tip end of the print sheet P is introduced to a portion between the paired secondary paper feed rollers 10 and detected by the sheet-in sensor S. After the passage of a predetermined time since this tip end is detected, the scraper roller 7 and the pickup roller 9 are stopped to rotate. At this moment, the tip end of the print sheet P abuts the portion between the paired secondary paper feed rollers 10 and the transfer of the print sheet P is stopped in a state in which the tip end side of the print sheet P is slightly bent.

Next, the paired secondary paper feed rollers 10 are rotated synchronously with the rotation of the printing drum (not shown), and the print sheet P, which has been transferred to the portion between the paired secondary paper feed rollers 10, is applied with a transfer force and thereby transferred to a portion between the printing drum (not shown) and the press roller (not shown) at predetermined timing. At this moment, the scraper roller 7 and the pickup roller 9 are press-contacted with the print sheet P. The scraper roller 7 and the pickup roller 9 run idle by device of the respective one-way clutches (not shown), thereby allowing the transfer of the print sheet P. The print sheet P is transferred between the printing drum (not shown) and the press roller (not shown) while being press-contacted with the printing drum and the press roller, and printing is conducted to the print sheet P in this press-contact and transfer process.

In the above-described operation, if the print sheets P to be used are thick, the user operates the operation member 20 to adjust the distance between the paired guide members 12 and 13 to be wide as shown in FIG. 6D. By doing so, the print sheets P are transferred to the transfer path 11 between the paired guide members 12 and 13 with a margin left. If the print sheets P to be used are thin paper, paper with less flexibility or the like, the distance of the paired guide members 12 and 13 is adjusted to be narrow as shown in FIG. 6B. By doing so, if passing through the transfer path 11 between the paired guide members 12 and 13, the print sheets P are subjected to correction of sheet corrugation and the corrugation-corrected print sheets P are introduced to the portion between the paired secondary guide rollers 10. It is, therefore, possible to prevent the generation of wrinkles of the print sheets P derived from the pressurization of corrugated portions by the paired secondary paper feed rollers 10. Accordingly, it is possible to prevent paper clogging if thick sheets are used as the print sheets P and to prevent sheets from being wrinkled if the sheets are thin.

If many print sheets P are transferred by the primary paper feed device 3 once and the print sheets P clog between the paired guide device 12 and 13, it is difficult for the user to remove the clogging sheets by the user's hands in the proposed paper feed apparatus. According to the present invention, by contrast with the proposed paper feed apparatus, it is possible to easily widen the distance between the paired guide members 12 and 13 and, therefore, possible for the user to remove the clogging sheets by the user's hands.

The guide distance adjustment device 14 has the operation member 20 which the user can operate. Since the guide distance adjustment device 14 is constituted to make the distance between the paired guide members 12 and 13 variable by the operation of this operation member 20, it is possible for the user to freely, arbitrarily change the distance between the paired guide members 12 and 13 in light of the thickness of sheets to be used.

The guide distance adjustment device 14 has the eccentric cams 22 which are rotatably provided. Since the guide distance adjustment device 14 is constituted to make the distance between the paired guide members 12 and 13 variable according to the rotating positions of the cams 22, it is possible for the user to easily change the distance between the paired guide members 12 and 13 by device of the eccentric cams 22 either continuously or by stages. In this embodiment, the distance between the paired guide members 12 and 13 are variable by stages. If the distance between the outer peripheral surface of each eccentric cam 22 and the rotation center of the cam 22 is set to be gradually variable, the distance between the paired guide members 12 and 13 can be varied continuously.

2. Second Embodiment

Hereinafter, the second embodiment of the present invention will be described with reference to FIGS. 5 to 8B. In the first embodiment, the paper feed apparatus is constituted to make the distance between the paired guide members 12 and 13 variable by the operation of the operation member 20. In the second embodiment, the operation member 20 for guide distance adjustment device 14 is not provided, and the eccentric cams 22 are rotated and moved in association with the operation of the paper feed pressure variable operation member 26, whereby the distance between a pair of guide members 12 and 13 are made variable. Specifically, when the paper feed pressure variable operation member 26 is located at the upper position (that is, low paper feed pressure (or ordinary sheet) position) indicated by the two-dot chain line shown in FIG. 7, the paired guide members 12 and 13 are moved to positions as shown in FIG. 6B or 6C, thereby changing the distance between the paired guide members 12 and 13. When the paper feed pressure variable operation member 26 is located at the lower position (that is, high paper feed pressure (or thick sheet) position) indicated by the solid line shown in FIG. 7, the paired guide members 12 and 13 are moved to positions as shown in FIG. 6D, thereby changing the distance between the paired guide members 12 and 13. The other constitution is the same as that of the first embodiment.

In the second embodiment, if print sheets P to be used are thick, the user operates the paper feed pressure variable operation member 26 so as to be located at the lower position. By doing so, a value of the paper feed pressure is set high to ensure the transfer of the print sheets P. The distance between the paired guide members 12 and 13 is set wide as shown in FIG. 6D, and the print sheets P are transferred to the transfer path between the paired guide members 12 and 13 with a margin left. If the print sheets P to be used are thin sheets, sheets with less flexibility or the like, the user operates the paper feed pressure variable operation member 26 so to be located at the upper position. By doing so, a value of the paper feed pressure is set low to ensure the transfer of the print sheets P. The distance between the paired guide members 12 and 13 is set narrow as shown in FIG. 6B or 6C. Accordingly, the print sheets P are subjected to correction of sheet corrugation at the time of passing through the transfer path 11 between the paired guide members 12 and 13, and introduced to the portion between a pair of secondary paper feed rollers 10. As a result, it is possible to prevent the generation of wrinkles of the print sheets P derived from the pressurization of corrugated portions by the paired secondary paper feed rollers 10.

As described above, the paper feed apparatus in the second embodiment can prevent paper clogging if the print sheets P to be used are thick sheets, and prevent the print sheets P from being wrinkled if the sheets P are thin sheets. If the user operates the paper feed pressure variable operation member 26, it is not necessary to operate the guide distance adjustment device 14.

In this case, the displacement positions of the paper feed pressure variable operation member 26 may be three or more, and the distance between the paired guide members 12 and 13 may be made adjustable to three stages in association with the displacement positions of the member 26.

3. Third Embodiment

Hereinafter, the third embodiment of the present invention will be described with reference to FIGS. 5 to 8B. In the first embodiment, the paper feed apparatus is constituted to make the distance between the paired guide members 12 and 13 variable by the operation of the operation member 20. In the third embodiment, however, the operation member 20 for guide distance adjustment device 6 is not provided the same as the case of the second embodiment. In the third embodiment, the paper feed apparatus is constituted to detect the slip ratio of print sheets P at the time of transferring the print sheets P to the secondary paper feed device 4 by the primary paper feed device 3, so as to rotate and move the eccentric cams 22 according to the slip ratio thus detected and so as to make the distance between a pair of guide members 12 and 13 variable. Specifically, a transfer time, that is, time between time at which the scraper roller 7 and the pickup roller 9 start to transfer the print sheet P and time at which a sheet-in sensor S detects the tip end of the print sheet P, is detected, so that a slide ratio is calculated based on this transfer time. As the print sheet P is thicker, the transfer time is longer and the slide ratio is higher. As the print sheet P is thinner, the transfer time is shorter and the slide ratio is lower. Accordingly, if the transfer time is equal to or shorter than a predetermined time, the paired guide members 12 and 13 are moved to positions as shown in FIG. 6B or 6C. If the transfer time is equal to or longer than the predetermined time, the paired guide members 12 and 13 are moved to a position as shown in FIG. 6D. The other constitution of this embodiment is the same as that of the first embodiment.

In the third embodiment, if print sheets P to be used are thick, the distance between the paired guide members 12 and 13 is set wide as shown in FIG. 6D and the print sheets P are transferred to a transfer path 11 between the paired guide members 12 and 13 with a margin left. If the print sheets P to be used are thin sheets, sheets with less flexibility or the like, the distance between the paired guide members 12 and 13 is set narrow as shown in FIG. 6B or 6C. Accordingly, the print sheets P are subjected to correction of sheet corrugation at the time of passing through the transfer path 11 between the paired guide members 12 and 13, and introduced to the portion between a pair of secondary paper feed rollers 10. It is, therefore, possible to prevent the generation of wrinkles of the print sheets P derived from the pressurization of corrugated portions by the paired secondary paper feed rollers 10.

As described above, the paper feed apparatus in the third embodiment can prevent paper clogging if thick sheets are used as the print sheets P, and prevent the print sheets P from being wrinkled if the sheets are thin. It is not necessary for the user to operate the guide distance adjustment device 6. Furthermore, it is not necessary for the user to operate the paper feed pressure variable operation member 26 as shown in the second embodiment. In this case, the distance between the paired guide members 12 and 13 may be adjustable to have three or more stages in association with the slide ratio.

In the above described each embodiment, the primary paper feed device 3 is constituted to include the scraper roller 7, the pickup roller 9 and the stripper plate 8. The constitution of the primary paper feed device 3 is freely set as long as the device can transfer the print sheets P on the paper feed tray 2 one by one. The distance between the paired guide members 12 and 13 is made variable by using the eccentric cams 22. The distance between the paired guide members 12 and 13 may be variable either by stages or continuously. The present invention is applied to the paper feed apparatus 1 of a stencil printing machine. The present invention is also applied not only to a printing machine other than the stencil printing machine but also to a copying machine or the like. The present invention is applicable to an arbitrary machine as long as the machine includes a paper feed apparatus sequentially transferring only an uppermost sheet out of a plurality of sheets mounted in a stacked state on a paper feed tray 2 at predetermined timing.

What is claimed is:

1. A paper feed apparatus comprising:

a paper feed tray for mounting a plurality of sheets in a stacked state;

primary paper feed means for sequentially transferring only the uppermost sheet out of the sheets on the paper feed tray;

a pair of secondary paper feed rollers arranged downstream of the primary paper feed means in a sheet transfer direction, and a pair of guide members providing a transfer path between the pair of guide members near the pair of secondary paper feed rollers;

secondary paper feed means for introducing tip ends of the sheets transferred by the primary paper feed means by using the pair of guide members to a portion between the paired secondary paper feed rollers, and for transferring the sheets introduced to the portion between the pair of secondary paper feed rollers to a transport downstream side according to rotation of the pair of secondary paper feed rollers; and guide distance adjustment means for making a distance between the pair of guide members variable, wherein the guide distance adjustment means comprises an operation member, and the guide distance adjustment means makes the distance between the pair of guide members variable by operating the operation member.

2. A paper feed apparatus comprising:

a paper feed tray for mounting a plurality of sheets in a stacked state;

primary paper feed means for sequentially transferring only the uppermost sheet out of the sheets on the paper feed tray;

a pair of secondary paper feed rollers arranged downstream of the primary paper feed means in a sheet transfer direction, and a pair of guide members providing a transfer path between the pair of guide members near the pair of secondary paper feed rollers;

secondary paper feed means for introducing tip ends of the sheets transferred by the primary paper feed means by using the pair of guide members to a portion between the paired secondary paper feed rollers, and for transferring the sheets introduced to the portion between the pair of secondary paper feed rollers to a transport downstream side according to rotation of the pair of secondary paper feed rollers; and guide distance adjustment means for making a distance between the pair of guide members variable, wherein the guide distance adjustment means comprises a rotatably provided eccentric cam, and the guide distance adjustment means makes the distance between the pair of guide members variable according to a rotation position of the eccentric cam.

3. A paper feed apparatus according to claim 2, wherein the paper feed apparatus is constituted to detect a slide ratio of the sheets when transferring the sheets to the secondary paper feed means by the primary paper feed mans, to drive the guide distance adjustment means according to the detected slide ratio and to thereby make the distance between the pair of guide members variable.

* * * * *

UNITED STATES PATENT AND TRADEMARK OFFICE

CERTIFICATE OF CORRECTION

PATENT NO. : 6,565,077 B1
DATED : May 20, 2003
INVENTOR(S) : Kawada

It is certified that error appears in the above-identified patent and that said Letters Patent is hereby corrected as shown below:

Column 12,
Line 7, change "mans" to -- means --.

Signed and Sealed this

Eighth Day of July, 2003

JAMES E. ROGAN
*Director of the United States Patent and Trademark Office*